]nited States Patent [19]

.atz et al.

[11] Patent Number: 4,597,239

[45] Date of Patent: Jul. 1, 1986

] LINING-FRAME OF LATTICEWORK CONSTRUCTION FOR GALLERIES, TUNNELS OR THE LIKE

[ ] Inventors: Klaus Matz; Gerhard Ritter; Klaus Ritter; Edgar Pollhammer, all of Graz, Austria

[ ] Assignee: AVI Alpenländische Veredelungs-Industrie Gesellschaft m.b.H., Graz, Austria

[ ] Appl. No.: 659,256

[ ] Filed: Oct. 10, 1984

[ ] Foreign Application Priority Data

)ct. 19, 1983 [AT] Austria ..... 3720/83

[ ] Int. Cl.[4] ..... E04B 1/32

[ ] U.S. Cl. ..... 52/644; 52/653; 52/694

[ ] Field of Search ..... 52/644, 86, 694, 653, 52/692

[56] References Cited

U.S. PATENT DOCUMENTS

| | | | |
|---|---|---|---|
| 555,015 | 2/1896 | Mannesmann | 52/694 |
| 2,421,197 | 5/1947 | Green | 52/692 |
| 2,465,074 | 3/1949 | Edge | 52/653 |
| 2,936,051 | 5/1960 | Martin | 52/694 |
| 4,335,556 | 6/1982 | Arnold | 52/694 |

FOREIGN PATENT DOCUMENTS

| | | | |
|---|---|---|---|
| 362739 | 6/1981 | Austria . | |
| 367860 | 8/1982 | Austria . | |
| 122846 | 1/1919 | United Kingdom | 52/86 |

*Primary Examiner*—James L. Ridgill, Jr.
*Attorney, Agent, or Firm*—Marmorek, Guttman & Rubenstein

[57] ABSTRACT

A lining-frame for a gallery or tunnel comprises two planar latticework trussed arches, each comprising an inner belt (3,4) and an outer belt (1,2) interconnected by a zig-zag rod chain (5,6). The arches are fixed parallel to one another by planar connector elements (81*a*,8-2*a*:81*b*,82*b*).

5 Claims, 10 Drawing Figures

LINING-FRAME OF LATTICEWORK CONSTRUCTION FOR GALLERIES, TUNNELS OR THE LIKE

The invention refers to a lining-frame of latticework construction for galleries, tunnels or the like, which has outer and inner belts associated with one another in pairs and in which one outer and one inner belt respectively are connected into a lattice at the apices of a rod chain bent in the form of a wave.

Lining-frames of this kind, known e.g. from Austrian Patent Specification No. 362,739, have a trapezoidal or triangular cross-section so that each of the open webs connecting the outer and inner belts lies in a conical, that is, a spatially curved surface. The open web which is first of all produced from relatively thick rods as a plane surface can only be brought into a conical shape by overcoming considerable resistance, and in this shape welded to the rods of the belts. As a result, these known lining-frame are complicated and therefore costly to produce.

Further, from Austrian Patent Specification No. 367,860, lining-frames of the same kind are known, in which there are used inner stiffening members, consisting of a number of rods bent sharply in the centre and corresponding with the number in the belt, extending at an inclination to the rods in the belt, and fastened by their outer ends, each to one rod of the belt.

An unrestricted uniting of the various elements of which this lining-frame consists, presupposes for the finished lining-frame high dimensional accuracy of the individual elements.

The object of the invention is to create a lining-frame of the kind initially referred to, in which the manufacture of the individual elements demands only low dimensional accuracy and the uniting of the elements into the finished lining-frame is possible without essential deformation and without constraint.

In accordance with the invention, this problem is solved by forming the lining-frame from at least two planar parallel trussed arches which are connected together by planar connector elements arranged at intervals along the trussed arches and having at least two arms which include an angle between them.

Through the plane construction of both the trussed arches and the connector elements the production and assembly of these parts become considerably simplified.

In a preferred embodiment of the invention, each connector element has two arms of unequal length, running at an acute angle to one another. In the case of two-armed connector elements of this kind, both ends and the apex of the point of bend of the two arms, that is, those points which are to be connected to the belts, always lie in one plane. Since also any three points along the four belts must always lie in one plane, unconstrained uniting of the individual parts is always guaranteed.

With the aid of embodiments the invention is now described in greater detail with reference to the accompanying drawings, in which.

Figure 3:
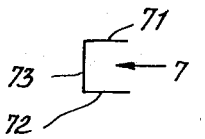
FIG. 3 shows a first embodiment of a connector element which is employed in the case of the frame as in FIGS. 1 and 2.
Figure 2:
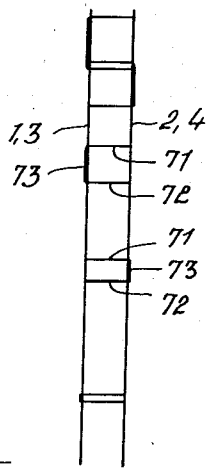
FIG. 2 is an elevation looking in a direction parallel with the planes of the two trussed arches from which the frame is formed.
Figure 1:
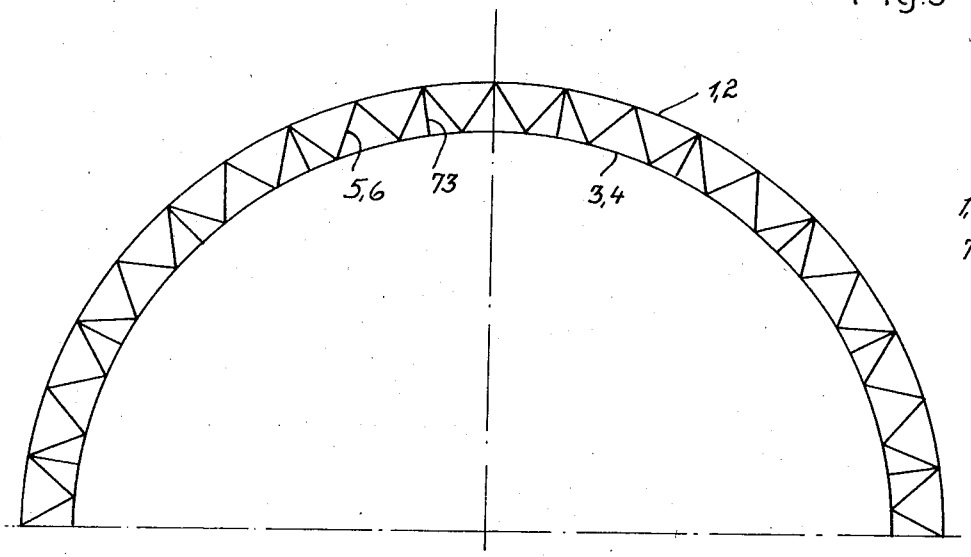
FIG. 1 is a side elevation of a lining frame in accordance with the invention.

In FIGS. 1 and 2 there may be seen a lining-frame, which is formed from two trussed arches having upper belts 1 and 2 and lower belts 3 and 4 which are respectively connected into a lattice by continuous rod chains 5, 6 bent into zig-zag shapes. Connector elements 7, which, according to FIG. 3, consist of parallel arms 71, 72 of equal length and a bridge 73 connecting the arms and arranged at right angles to them, are arranged at intervals along the frame in such a way that the arms run perpendicularly to the planes of the two lattice frames and the bridges run radially in the plane of one of the two lattice frames.

Obviously the frame will not in practice consist as illustrated of one piece but is built up in known manner out of individual sectors which can be united into the whole frame by connectors which are not illustrated because they do not form the substance of the invention.

Figure 4:
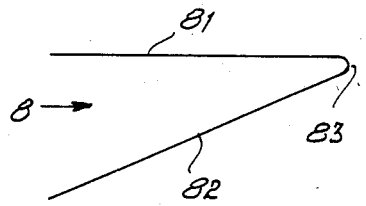
FIG. 4 shows a preferred second embodiment of a connector element.

According to the preferred embodiment of the invention a connector element 8 consists, as shown in FIG. 4, of a shorter arm 81 and a longer arm 82 which include between them an acute angle. In contrast to the connector elements 7 which are fixed, preferably welded, to the trussed arches at four points, namely, each at one point to each belt, the connector elements 8 are connected respectively at only three points to the trussed arches, that is, the free ends of the two arms 81, 82, each to one of the two belts of the same trussed arch and the apex or point of bend 83 to one belt of the second trussed arch, the shorter arm of the connector element connecting in each case the corresponding belts of the two trussed arches. This measure of connecting the connector elements at only three points to the two trussed arches, allows of the arrangement of the connector elements at entirely optional inclinations with respect to a plane radial to the arches and perpendicular to the surface of the trussed arches, so that manifold different spatial possibilities of connection between the trussed arches can be realized.

Figure 5:
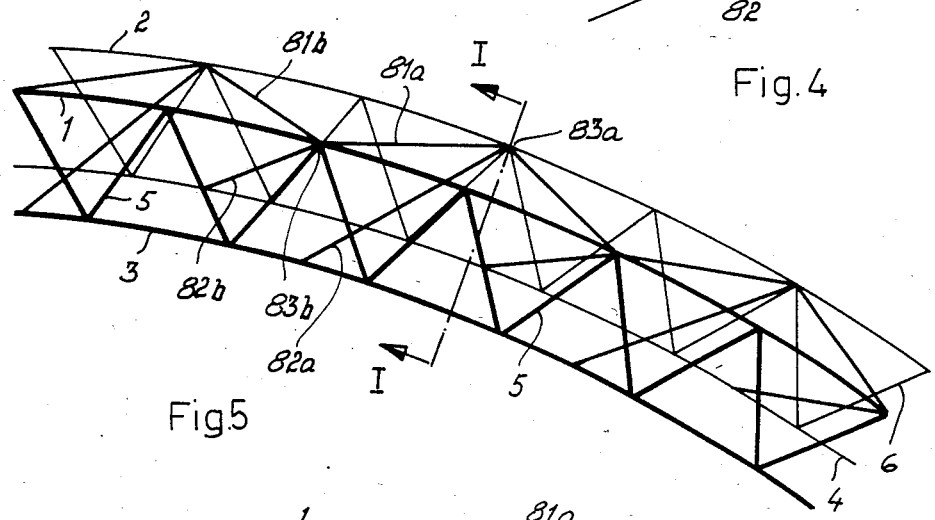
FIG. 5 is an axonometric elevation of a partial region of a lining-frame with connector members according to FIG. 4.
Figure 6:
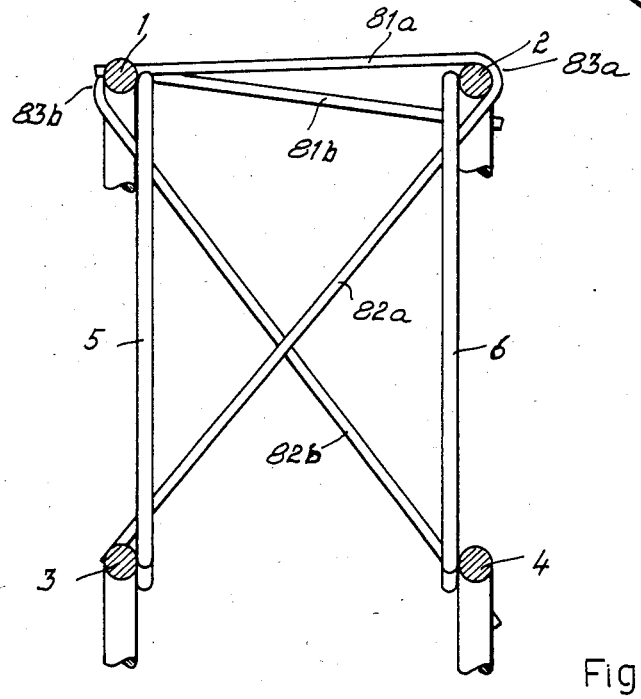
FIG. 6 is a section taken on the line I—I in FIG. 4.

In FIGS. 5 and 6 there may be seen, for example, the shorter arm 81*a* of a connector element 8 directly adjacent to the plane of section I—I provided with the suffix a, which connects the upper belts 1 and 2 of the two trussed arches and is fixed to them, preferably by welding. The apex 83*a* of this connector member 8*a* wraps round the upper belt 2 and the end of the longer arm 82*a* is welded to the lower belt 3 of the same trussed arch to which the upper belt 1 belongs.

The next connector element 8, provided with the index b, the shorter arm of which is designated by 81*b* and the longer by 82*b*, runs in the opposite direction so that its apex 83*b* wraps round the upper belt 1. The arms 81, 82 of all of the connector elements 8 form, in this arrangement, a strutting which prevents shifting of the two trussed arches in parallel with their planes.

The arrangement may be modified further in various ways. The connector elements may, for example, be arranged as a whole spaced apart and parallel with one another in planes radial to the trussed arches. But a more robust connection of the two arches results if the shorter arms 81 of adjacent connector elements 8, which in the example shown connect the upper belts of the two trussed arches, are respectively arranged in pairs inclined symmetrically with respect to a plane radial to the two trussed arches. Still greater stiffness is finally achieved when as illustrated in FIG. 5, along each of the two belts 1, 2 connected by the shorter arms 81 of the connector element, the points of attachment of adjacent connector members, e.g., 8*a*, 8*b*, are arranged so closely adjacent that the shorter arms 81 of the connector members form between these two belts 1, 2 an at least approximately continuous open web.

Figure 7:
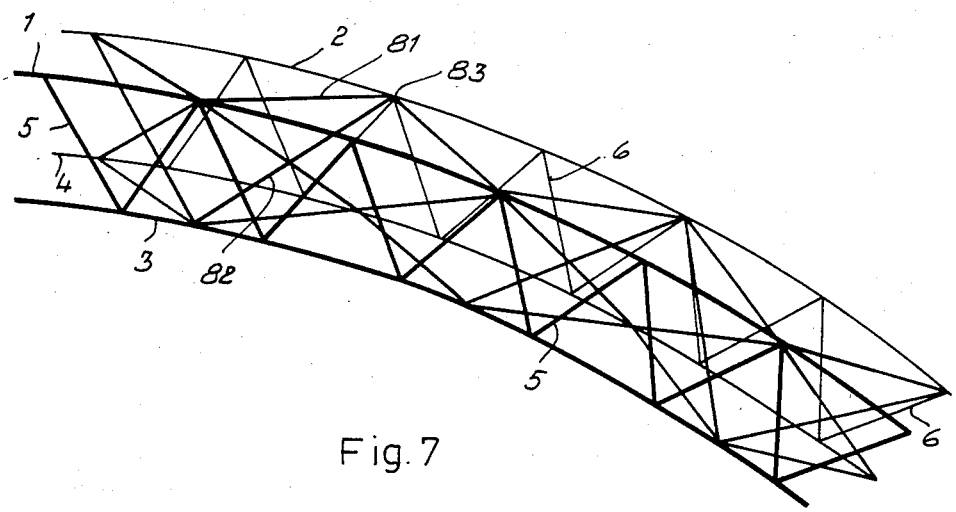
FIG. 7 is an axonometric elevation of a partial region of a lining-frame with a reinforced open web with connector members as in FIG. 4.
Figure 8:
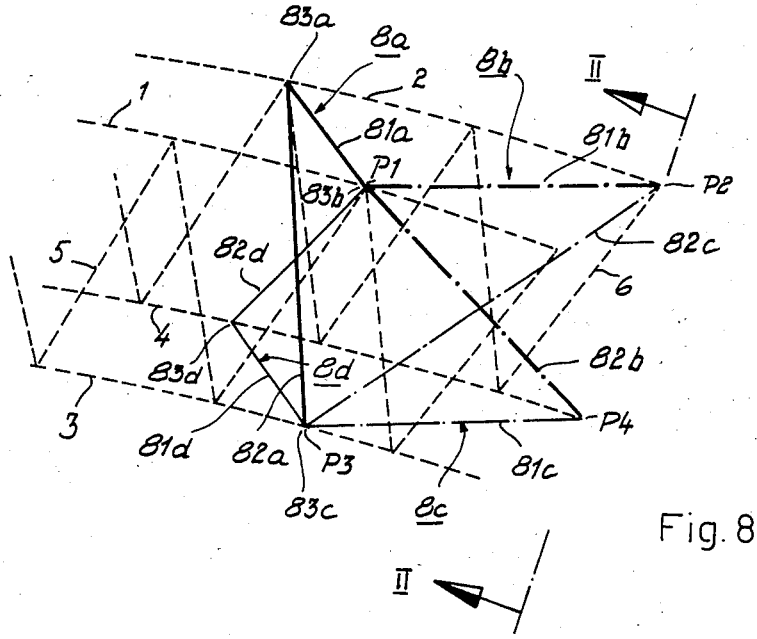
FIG. 8 shows a detail of the arrangement of the connector members in a lining-frame as in FIG. 7.
Figure 9:
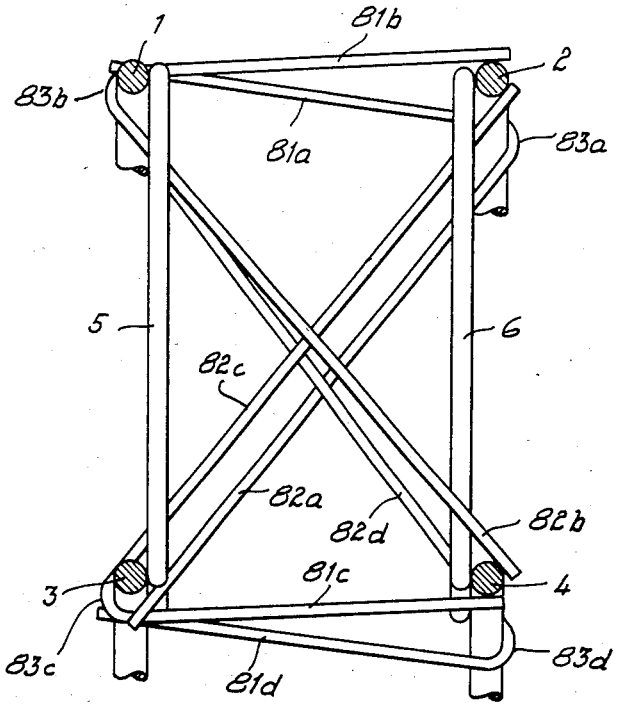
FIG. 9 is a section taken on the line II—II in FIG. 8.

FIGS. 7 to 9 show a refinement upon a lining-frame in accordance with the invention, through which the stiffness of the lining-frame may be still further increased. In this connection it may be mentioned that the different thicknesses of line in FIGS. 5, 7 and 8 merely serve for better distinction between the two trussed arches and the connector members and have no reference to the diameters of the rods employed. In particular in FIG. 8 the two arms of four connector elements 8*a*, 8*b*, 8*c* and 8*d* are respectively characterised as belonging together by lines of the same thicknesses and the same pattern.

As may best be seen from FIGS. 8 and 9, two connector elements 8*b* and 8*c* formed by the arms 81*b*, 82*b* and 81*c*, 82*c* respectively, are arranged directly adjacent to the plane of section II—II. Since the points P1 and P3 at which the connector elements 8*b* and 8*c* ae connected to the trussed arch 1, 3, 5, and the points P2 and P4 at which the connector elements 8*b* and 8*c* are connected to the trussed arch 2, 4, 6, lie in different planes radial to the trussed arches, the points P1, P2, P3 and P1, P2, P4 respectively define planes which intersect. The arms 82*b*, 82*c* therefore cross one another askew in space.

The apex 83*c* between the arms 81*c* and 82*c* surrounds the lower belt 3 and the apex 83*b* between the arms 81*b* and 82*b* surrounds the upper belt 1. The next pair of connector elements 8*a*, 8*d* surrounds at the apex 83*a* betwen the arms 81*a* and 82*a* the upper belt 2 and at the apex 83*d* between the arms 81*d* and 82*d* the lower belt 4.

As may be seen especially from FIG. 8, in the case of this arrangement of the connector elements, the arms 81*a*, 81*b* . . . form a continuous open web between the upper belts 1, 2 of the two trussed arches. The arms 81*c*, 81*d* . . . form a continuous open web between the lower belts 3, 4. Further, the arms 82*a*, 82*c* . . . of the connector elements, acting as struts, form an open web between the upper belt 2 of the one trussed arch and the lower belt 3 of the second trussed arch lying opposite, and similarly the arms 82*b*, 82*d* . . . acting as struts form an open web between the upper belt 1 and the lower belt 4, so that in the case of the open web according to FIGS. 7 to 9 every rod in the belts of the two trussed arches is connected to every other belt rod into a lattice. Since the connection between the individual trusses arches is effected throughout by connector elements of the same kind, as in FIG. 4, the degree of stiffening even within one lining-frame may be altered without any difficulty, say, in the form that in the roof region a strutting as in FIGS. 7 to 9 is chosen, but in the remaining regions of the frame a construction according to FIGS. 5 and 6 is chosen.

Figure 10:
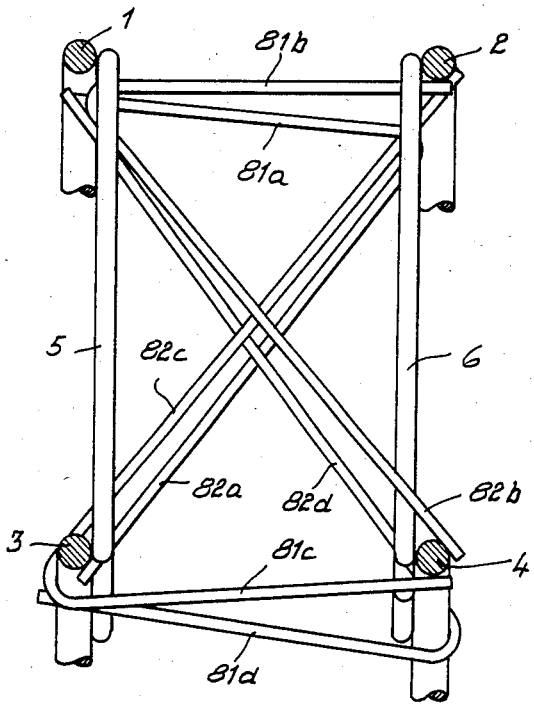
FIG. 10 is a similar section through a modified embodiment.

Whilst in the case of the embodiments according to FIGS. 6 and 9 the points of bend 83*a*, 83*b* . . . of the connector elements 8*a*, 8*b* . . . in each case wrap round the outside of one of the belts 1–4 of the two trussed arches, it may under certain circumstances, for example, for facilitating the fitting of temporary shuttering, be advantageous to arrange the belts of the trussed arches lying on the outside as shown in FIG. 10.

Finally lining-frames having an outline other than circular, say, frames in the shape of a parabola, may also be produced in the same simple way.

We claim:

1. In a lining frame of lattice work construction for galleries, tunnels or the like, said frame having a plurality of pairs of belts, each said pair comprising an outer belt and an associated inner belt connected thereto into a trussed lattice arch by a rod chain bent in the form of a wave and fixed at the apices thereof to said inner and outer belts, the improvement comprising at least two of said trussed arches which are planar and are fixed together parallel to one another by planar connector elements arranged at intervals along said arches, each connector element having a shorter arm and a longer arm, running at an acute angle to one another from an apex thereof, said connector elements being arranged regularly circumferentially of said arches, said apices of said connector elements being fixed to different ones of said belts in sequence whilst said two arms of each of said connector elements extend from said apex thereof at one of said belts of one of said trusses as struts toward, and are fixed to, respective ones of said belt of the other of said trusses.

2. A lining-frame according to claim 1, wherein said connector element apices wrap round the outsides of respective ones of said belts.

3. A lining-frame according to claim 1, wherein said two arms of each of said connector elements are fixed to said belts of said other of said trusses in a radial plane of said arches.

4. A lining-frame according to claim 1, wherein said shorter arms of adjacent ones of said connector elements connecting corresponding inner or outer ones of said belts of said two arches are mutually inclined in pairs in opposite senses and are closely adjacent to form between said corresponding belts a substantially continuous open web.

5. A lining-frame according to claim 1, wherein, at least in partial regions thereof, both said outer belts and said inner belts are connected together by said shorter arms of said connector elements.

* * * * *